US011951380B1

(12) United States Patent
Macklin et al.

(10) Patent No.: US 11,951,380 B1
(45) Date of Patent: Apr. 9, 2024

(54) SKATEBOARD GRINDING DEVICE

(71) Applicants: Daniel Bradley Macklin, Portland, OR (US); Bradley William Macklin, Portland, OR (US)

(72) Inventors: Daniel Bradley Macklin, Portland, OR (US); Bradley William Macklin, Portland, OR (US)

( * ) Notice: Subject to any disclaimer, the term of this patent is extended or adjusted under 35 U.S.C. 154(b) by 0 days.

(21) Appl. No.: 17/833,687

(22) Filed: Jun. 6, 2022

Related U.S. Application Data

(60) Provisional application No. 63/213,608, filed on Jun. 22, 2021.

(51) Int. Cl.
*A63C 17/00* (2006.01)
*A63C 17/01* (2006.01)

(52) U.S. Cl.
CPC ..... *A63C 17/0006* (2013.01); *A63C 17/01* (2013.01)

(58) Field of Classification Search
CPC ..... A63C 17/0006; A63C 17/01; B60B 7/00; B60B 7/0013
See application file for complete search history.

(56) References Cited

U.S. PATENT DOCUMENTS 4,270,764 A * 6/1981 Yamada ..... A63C 17/01 280/288.4
4,962,968 A * 10/1990 Caplin ..... B60B 7/00 301/5.301
6,953,225 B2 * 10/2005 Gallagher ..... A63C 17/01 301/5.304
9,211,469 B2 * 12/2015 Lane ..... A63C 17/017
2006/0108857 A1 * 5/2006 Simon ..... A63C 17/226 301/5.301
2014/0084560 A1 * 3/2014 Gillan ..... B60T 3/00 280/80.1
2016/0101648 A1 * 4/2016 Edwards ..... A63C 17/26 301/37.109
2016/0317902 A1 * 11/2016 Janocha ..... B60B 7/0013

FOREIGN PATENT DOCUMENTS

TR 201606878 A2 * 12/2017

* cited by examiner

*Primary Examiner* — James A Shriver, II
*Assistant Examiner* — Michael T. Walsh
(74) *Attorney, Agent, or Firm* — Plager Schack LLP; Mark H. Plager; Naomi Mann

(57) ABSTRACT

Disclosed is a skateboard grinding device configured to install within a skateboard wheel for facilitating grinding of the skateboard on an object.

8 Claims, 4 Drawing Sheets

SKATEBOARD GRINDING DEVICE

RELATED APPLICATION

This application claims benefit to U.S. Provisional Application No. 63/213,608 filed Jun. 22, 2021, which is incorporated by reference herein in its entirety.

BACKGROUND

The embodiments herein relate generally to skateboards and skateboard grinding systems.

Skateboarders often maneuver the skateboard to grind on an object such as a rail. This act of grinding occurs when the skateboarder's weight is on the board while allowing the skateboard to glide along the object. Currently, the wheels of the skateboard do not glide smoothly on rails or other objects, which greatly reduces the length of time the skateboard can grind on the object. Further, the act of grinding a skateboard on an object increases wear on the skateboard's wheels when they contact the object. As such, there is a need in the industry for an improved skateboard system for grinding a skateboard on an object.

SUMMARY

Disclosed is a skateboard grinding device configured to install within a skateboard wheel for facilitating grinding of the skateboard on an object, the grinding device comprising: an outer face configured to fit within a well of a skateboard wheel and to cover at least a portion of a surface on an inner side of the wheel; a central opening configured to align with a central opening within the wheel, wherein the outer face expands radially outwards with respect to the central opening; and at least one horizontal wall between the central opening and the outer face, the horizontal wall configured to friction fit against an internal wall within the well of the skateboard wheel, wherein the grinding device is configured to provide a contact buffer between a surface on an inner side of the wheel and object on which the skateboard is grinded when installed into the skateboard wheel.

In some embodiments, the outer face is generally structured as a flat disk. In further embodiments, the outer face including a flared outer edge that bends towards the central opening. In yet further embodiments, the grinding device comprises a first inner face continuously connected to the outer face via a first horizontal wall. In yet further embodiments, the grinding device comprises a second inner face continuously connected to the first inner face via a second horizontal wall, wherein the second horizontal wall is configured to friction fit against said internal wall within the well of the skateboard wheel. In some embodiments, the grinding device is made of a plastic material.

According to various embodiments, disclosed is a skateboard grinding method for facilitating grinding of a skateboard on an object, the method comprising: inserting and attaching a grinding device into a well of at least one wheel of the skateboard, wherein the grinding device comprises an outer face configured to cover at least a portion of a surface on an inner side of the wheel, and wherein the grinding device is configured to provide a contact buffer between a surface on an inner side of the wheel and object on which the skateboard is grinded when installed into the skateboard wheel. In some embodiments, the grinding device further comprising a central opening configured to align with a central opening within the wheel, wherein the outer face expands radially outwards with respect to the central opening, and wherein attaching the grinding device comprises aligning the central opening of the grinding device against the central opening of the wheel, inserting an axle of the skateboard through the aligned central openings, and securing the wheel and grinding device to the axle using attachment hardware. In yet further embodiments, the outer face includes a flared outer edge that bends towards the central opening. In yet further embodiments, the grinding device includes at least one horizontal wall between the central opening and the outer face, the horizontal wall configured to friction fit against an internal wall within the well of the skateboard wheel, wherein attaching the grinding device comprises pressing the grinding device into the well of the skateboard wheel.

DETAILED DESCRIPTION OF CERTAIN EMBODIMENTS

The detailed description of some embodiments of the invention will be made below with reference to the accompanying figures, wherein the figures disclose one or more embodiments of the present invention.

Figure 1:
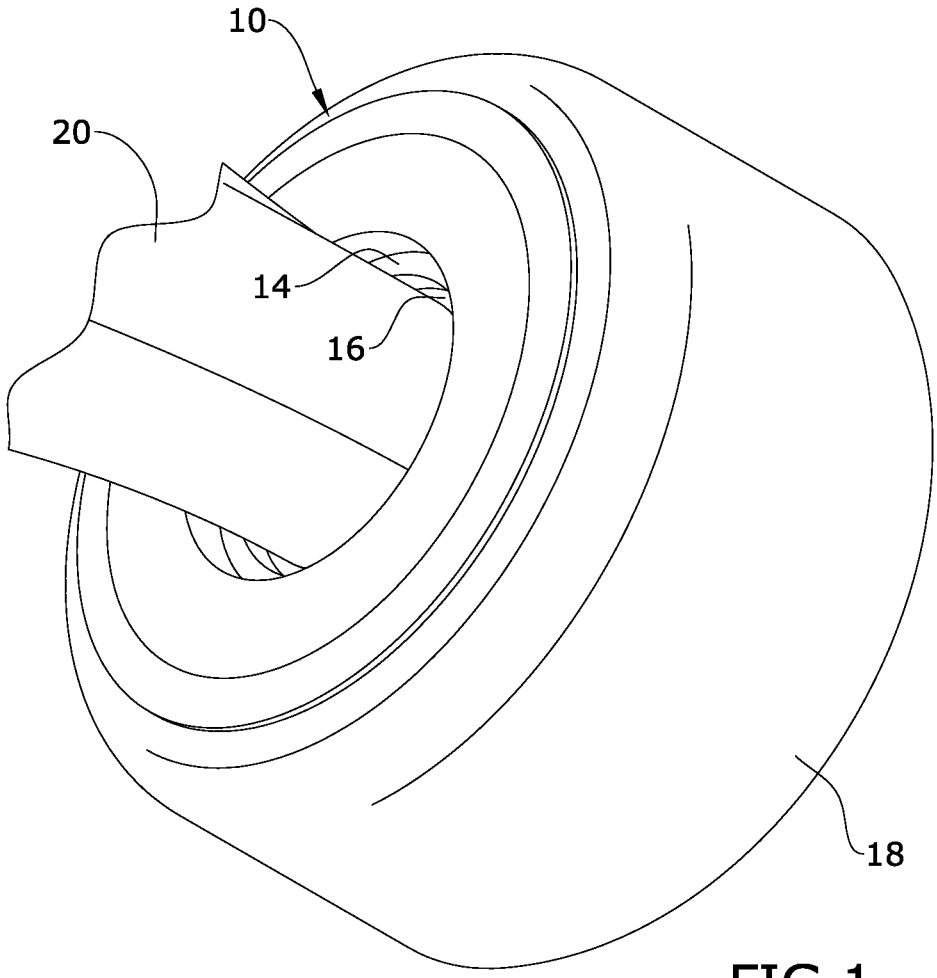
FIG. 1 is a detailed perspective view of a skateboard grinding device according to various embodiments, shown installed.
Figure 2:
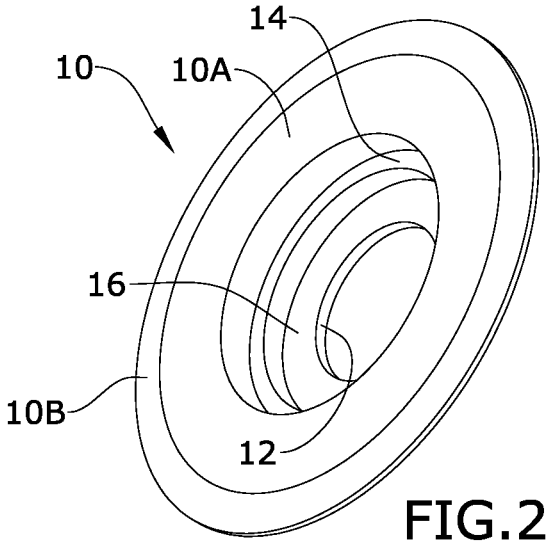
FIG. 2 is a perspective view of the skateboard grinding device.
Figure 3:
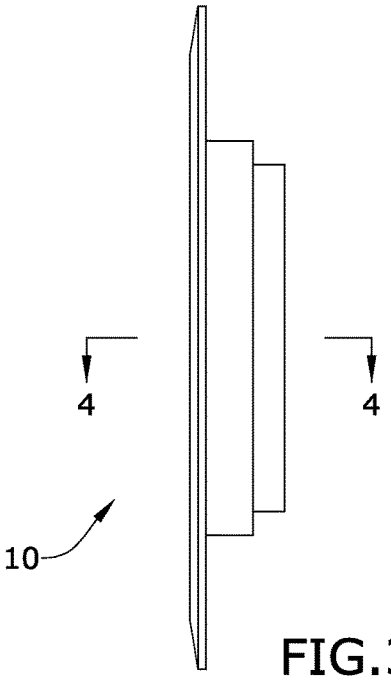
FIG. 3 is a side view thereof.
Figure 4:
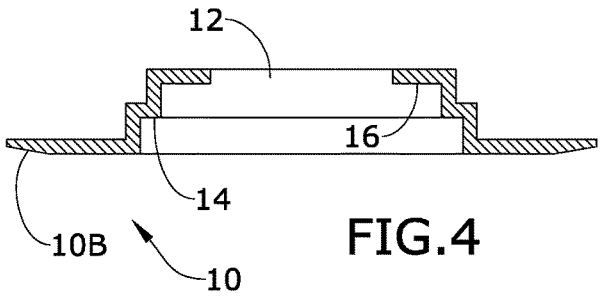
FIG. 4 is a section view taken along line 4-4 of FIG. 3.
Figure 5:
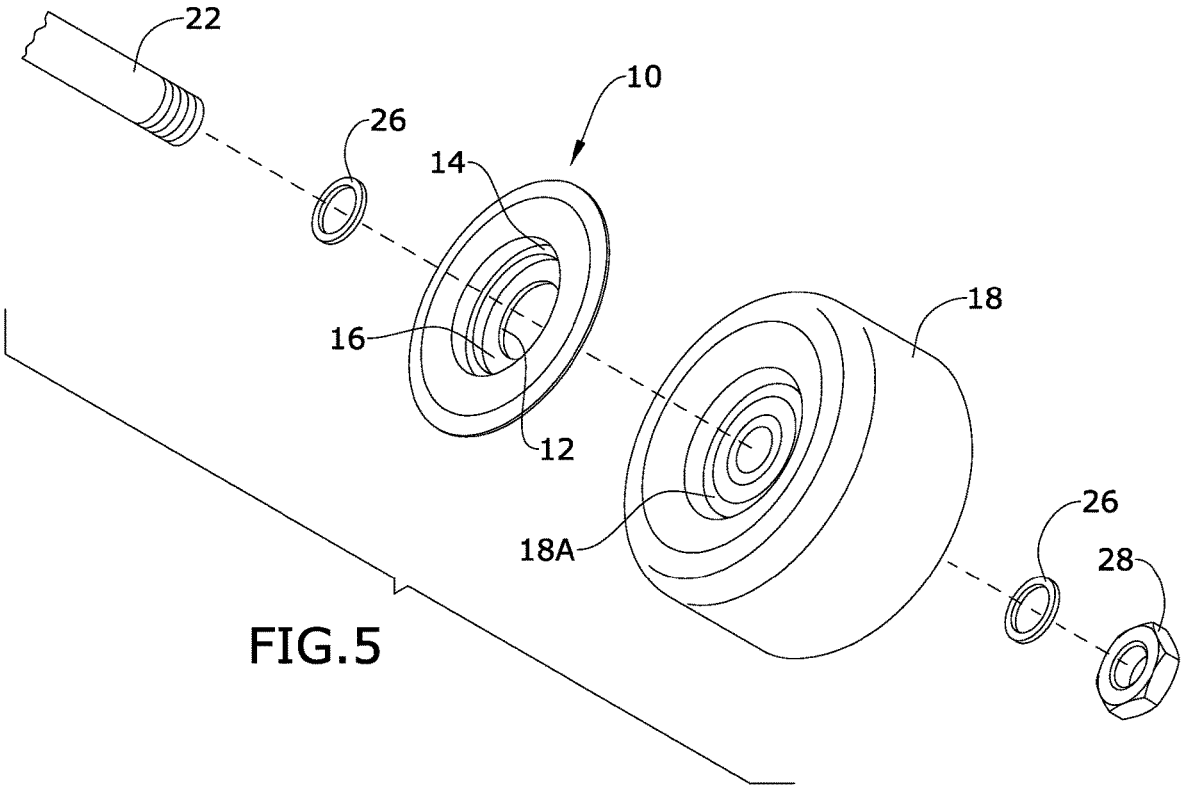
FIG. 5 is an exploded view of the skateboard grinding device assembly.
Figure 6:
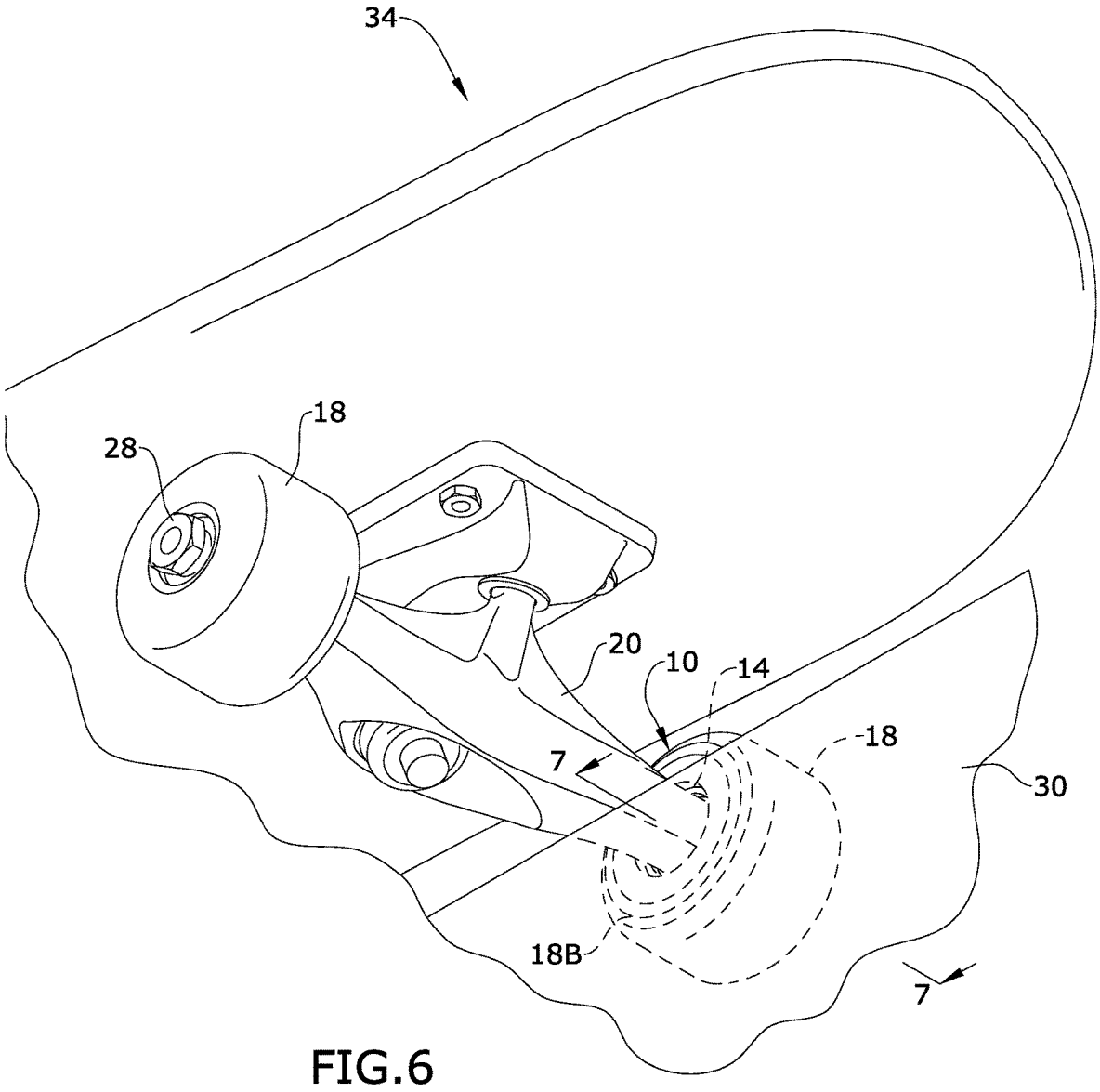
FIG. 6 is a perspective view of the skateboard grinding device shown in use.
Figure 7:
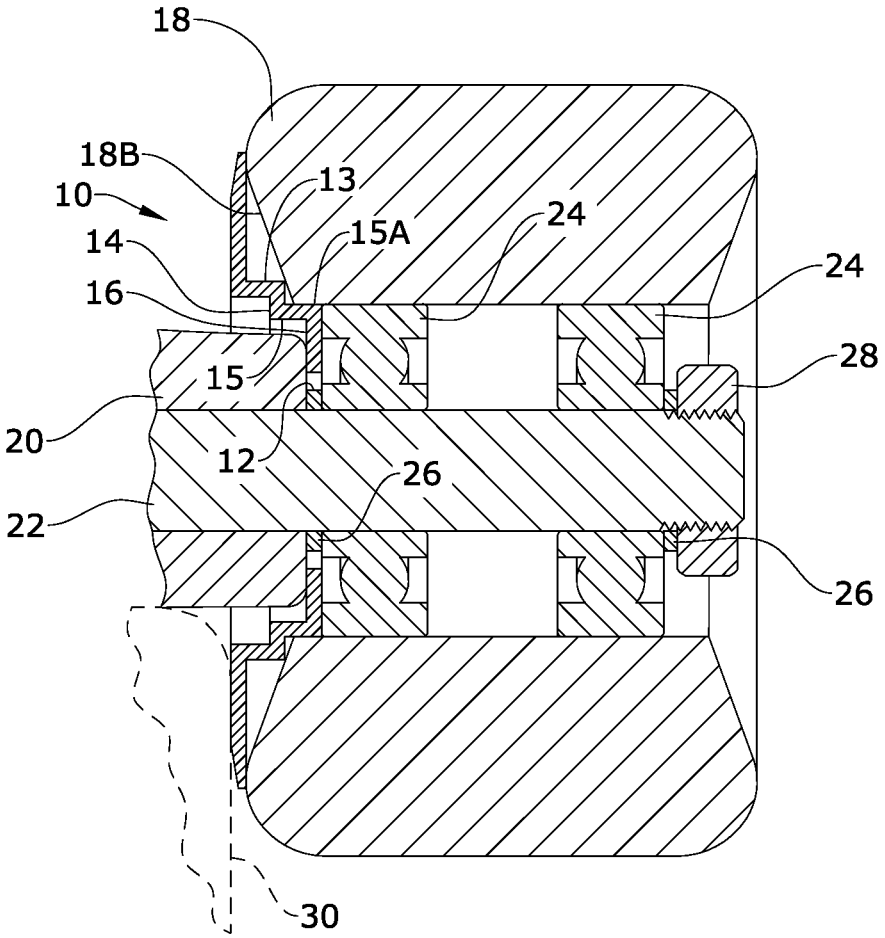
FIG. 7 is a section view taken along line 7-7 of FIG. 6.

In certain embodiments as depicted in FIGS. 1-7, disclosed is a grinding device 10 configured to insert into a well 18A of a wheel 18 on a skateboard 34, and may serve as a surface that enhances grinding of the skateboard on an object 30 such as a ledge or rail. In some embodiments, grinding device 10 may protect the skateboard's wheels from premature wear during grinding. In further embodiments, grinding device 10 may glide smoothly on object 30 to increase the ease and/or length of time of skateboard grind.

Skateboard 34 may generally comprise a skateboard deck 32, at least one truck hanger 20 coupled to the underside of skateboard deck 32 and supporting a wheel axle 22, wherein the wheel axle is configured to rotationally support a pair of wheels. In certain embodiments, each wheel 18 may comprise bearings 24 for engagement with axle 22. Typically, skateboard 34 may include a front hanger including a front axle supporting a front pair of wheels, and a back hanger including a back axle supporting a back pair of wheels. It shall be appreciated that the disclosed grinder may apply to various skateboard designs in different embodiments.

In embodiments, grinding device 10 is configured to situate within well 18A and may be precisely designed to remain in place within the wheel well, with deviation from its place corrected by incidental contact with the hanger 20. In further embodiments, grinding device 10 may be attached using the same attachment hardware used for attachment of the wheel to the skateboard axle. Grinding device 10 is further configured to provide a contact buffer between a surface 18B on an inner side of wheel 18 and object 30 during grinding wherein the inner side of wheel 18 is the side of the wheel closest to truck hanger 20 when the wheel is attached to the skateboard, and wherein the surface would otherwise be exposed without the grinding device installed to the wheel.

In embodiments, grinding device 10 may generally comprise an outer face 10A configured to fit within well 18B and to cover at least a portion of surface 18B of the wheel. Grinding device may further comprise a central opening 12 configured to align with a central opening within wheel 18. In further embodiments, grinding device 10 may include at least one horizontal wall between central opening 12 and outer face 10A, the horizontal wall configured to press or friction fit against an internal wall of well 18A.

In embodiments, outer face is generally structured as a disk and expands radially outwards with respect to central opening 12. In certain embodiments, outer face 10A may be flat, but is not limited to this option. In some embodiments, outer face 10A may include a flared outer edge 10B that bends towards central opening 12. In one embodiment, grinding device 10 may further comprise a first inner face 14 continuously connected to outer face 10A via a first horizontal wall 13, and a second inner face 16 continuously connected to first inner face 14 via a second horizontal wall 15, wherein the second inner face may be configured to rest within the well and against the bearings. In embodiments, second horizontal wall 15 may be configured to press or friction fit against an internal wall 15A of well 18A to hold grinding device 10 within well 18A. During grinding, outer face 10A and/or flared outer edge 10B may contact object 30. In embodiments, grinding device 10 may be made from PTA plastic or other similar material. However, grinding device 10 can be made from any other material or combination of materials such as other plastics or materials known in the field, which may enhance grinding and/or smoothness of grinding.

It shall be appreciated that the dimensions and geometric configuration of grinding device 10 may vary in alternate embodiments. In one embodiment, outer face 10A may have an outer diameter of approximately 42 mm, first inner face 14 may have an outer diameter of approximately 25 mm, second inner face 16 may have a diameter of approximately 22 mm, and central opening 12 may have a diameter of approximately 13 mm. Additionally, first horizontal wall 13 may be approximately 2 mm long, second horizontal wall 15 may be approximately 3 mm long, and the thicknesses of first and second inner faces 14, 16 may each be about 0.5 mm.

During installation, grinding device 10 may be inserted into the well 18A of wheel 18 with the wheel bearing 24 in place, wherein grinding device 10 and wheel 18 may remain connected together by a snap or friction fit. Axle 22 may be insert through central opening 12 of grinding device 10 and the central opening within wheel 18, wherein the grinding device and wheel may be secured to the axle/trunk of the skateboard using attachment hardware such as washers 26 and nut 28, as shown. In certain embodiments, nut 28 and/or washers 26 may be part of the installation hardware of the wheel. As such, a user may remove the wheel of the skateboard, and reinstall the wheel together with the grinding device. In a preferred embodiment, four grinding device 10 may be attached to the wells of the four wheels of a skateboard. During use, the skateboarder may ride the skateboard in a conventional manner. During grinding, the skateboarder may maneuver the board to glide on object 30, wherein any number of grinding devices 10 may contact an object 30 on which the skateboard grinds to protect the wheel(s) from wear and allow the skateboarder to smoothly grind the skateboard for longer continuous periods of time. As the device makes contact with the surface a skater grinds, rather than the wheel, any type of wheels may be used to grind. Additionally, the device provides more surface area with less friction than any wheel for grinding. It shall be appreciated that the disclosed device may be used with any type of skateboard and skateboard wheels.

It shall be appreciated that the components of the grinding device described in several embodiments herein may comprise any alternative known materials in the field and be of any color, size and/or dimensions. It shall be appreciated that the components of the grinding device described herein may be manufactured and assembled using any known techniques in the field. In embodiments, the device may comprise one piece created using a 3D printer. Additionally, the device may be made from various materials, including nylon, metal and the like.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A skateboard grinding device configured to be installed within a skateboard wheel for facilitating grinding of the skateboard on an object, the grinding device comprising:

an outer face configured to fit within a well of a skateboard wheel and to cover at least a portion of a surface on an inner side of the wheel;

a central opening configured to align with a central opening within the wheel, wherein the outer face expands radially outwards with respect to the central opening;

a first inner face continuously connected to the outer face via a first horizontal wall, and a second inner face continuously connected to the first inner face via a second horizontal wall, wherein the second horizontal wall is configured to friction fit against an internal wall within the well of the skateboard wheel, wherein the grinding device is configured to provide a contact buffer between a surface on an inner side of the wheel and object on which the skateboard is grinded when installed into the skateboard wheel.

2. The skateboard grinding device of claim 1, wherein the outer face is generally structured as a flat disk.

3. The skateboard grinding device of claim 2, said outer face including a chamfered outer edge.

4. The skateboard grinding device of claim 1, said grinding device being made of a plastic material.

5. A skateboard grinding method for facilitating grinding of a skateboard on an object, the method comprising:

inserting and attaching a grinding device into a well of at least one wheel of the skateboard, wherein the grinding device comprises:

an outer face configured to fit within the well of the wheel and to cover at least a portion of a surface on an inner side of the wheel, a central opening configured to align with a central opening within the wheel, wherein the outer face expands radially outwards with respect to the central opening;

a first inner face continuously connected to the outer face via a first horizontal wall, and a second inner face continuously connected to the first inner face via a second horizontal wall, wherein the second horizontal wall is configured to friction fit against an internal wall within the well of the skateboard wheel, wherein the grinding device is configured to provide a contact buffer between a surface on an inner side of the wheel and object on which the skateboard is grinded when installed into the skateboard wheel.

6. The skateboard grinding method of claim 5, wherein attaching the grinding device comprises aligning the central opening of the grinding device against the central opening of the wheel, inserting an axle of the skateboard through the aligned central openings, and securing the wheel and grinding device to the axle using attachment hardware.

7. The skateboard grinding method of claim 6, said outer face including a chamfered outer edge.

8. The skateboard grinding method of claim 5, wherein attaching the grinding device comprises pressing the grinding device into the well of the skateboard wheel.

* * * * *